US010378291B2

(12) United States Patent
Frelat et al.

(10) Patent No.: US 10,378,291 B2
(45) Date of Patent: Aug. 13, 2019

(54) WEAR BUSHING RETRIEVING SYSTEM AND METHOD

(71) Applicant: Cameron International Corporation, Houston, TX (US)

(72) Inventors: Olivier Frelat, Vias (FR); Patrice Paul Louis Couren, Lieuran-les-Beziers (FR); Sebastien Noel Albert Bories, Nissan-lez-Enserune (FR)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/638,224

(22) Filed: Jun. 29, 2017

(65) Prior Publication Data

US 2018/0002993 A1 Jan. 4, 2018

(30) Foreign Application Priority Data

Jun. 29, 2016 (EP) ..... 16305792

(51) Int. Cl.

| | |
|---|---|
| ***E21B 17/10*** | (2006.01) |
| ***E21B 17/12*** | (2006.01) |
| ***E21B 23/00*** | (2006.01) |
| ***E21B 31/20*** | (2006.01) |
| ***E21B 23/03*** | (2006.01) |

(52) U.S. Cl.

CPC ..... *E21B 17/1007* (2013.01); *E21B 17/10* (2013.01); *E21B 17/12* (2013.01); *E21B 23/00* (2013.01); *E21B 23/03* (2013.01); *E21B 31/20* (2013.01)

(58) Field of Classification Search

CPC ..... E21B 17/10; E21B 17/1007; E21B 17/12; E21B 23/00; E21B 23/03; E21B 31/20

See application file for complete search history.

(56) References Cited

U.S. PATENT DOCUMENTS 3,225,833 A * 12/1965 Parkhurst ..... E21B 33/043 166/207
3,473,608 A * 10/1969 Castille ..... E21B 17/1007 166/212
3,645,328 A * 2/1972 Greene, Jr. ..... E21B 17/12 166/217
4,109,728 A * 8/1978 Sanford ..... E21B 17/1007 166/217

(Continued)

FOREIGN PATENT DOCUMENTS

GB 2170534 A 8/1986

OTHER PUBLICATIONS

PCT International Search Report & Written Opinion for PCT Application No. PCT/US2017/040129 dated Oct. 20, 2017, 10 pgs.

*Primary Examiner* — Matthew R Buck
(74) *Attorney, Agent, or Firm* — Fletcher Yoder, P.C.

(57) ABSTRACT

A system includes a wear bushing retrieval tool. The wear bushing retrieval tool an annular main body configured to be disposed about a tubular string, a plurality of locking dogs, wherein each locking dog of the plurality of locking dogs is pivotably coupled to the annular main body, a first axial securement feature coupled to the annular main body, and a second axial securement feature coupled to the main body, wherein the first and second axial securement features are configured to cooperatively axially capture a coupling of the tubular string when the annular main body is disposed about the tubular string.

20 Claims, 6 Drawing Sheets

(56) References Cited

U.S. PATENT DOCUMENTS

| | | | | |
|---|---|---|---|---|
| 4,995,458 | A * | 2/1991 | Garbett | E21B 17/1007 166/85.3 |
| 7,284,616 | B2 * | 10/2007 | Williams | E21B 17/1007 166/381 |
| 2002/0092656 | A1 | 7/2002 | Ford et al. | |

* cited by examiner

WEAR BUSHING RETRIEVING SYSTEM AND METHOD

CROSS REFERENCE TO RELATED APPLICATION

This application claims priority to and benefit of EP Patent Application No. EP16305792.0, entitled "WEAR BUSHING RETRIEVAL SYSTEM AND METHOD", filed Jun. 29, 2016, which is herein incorporated by reference in its entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as various control lines, casings, valves, and the like, that control drilling and/or extraction operations.

In drilling and extraction operations, various components and tools, in addition to and including wellheads, are employed to provide for drilling, completion, and production of a mineral resource. For example, a long pipe, such as a casing, may be lowered into the earth through the wellhead assembly to enable access to the natural resource. Additional pipes and/or tubes may then be run through the casing to facilitate extraction of the resource. In certain circumstances, additional elements may be coupled to the long pipe run through the wellhead, such as centralizers. Unfortunately, running of long pipe, such as casing, and components coupled to the long pipe through the wellhead assembly can potentially cause premature wear and/or degradation to one or more wellhead assembly components from unintended or undesired contact between the pipe and the wellhead assembly.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
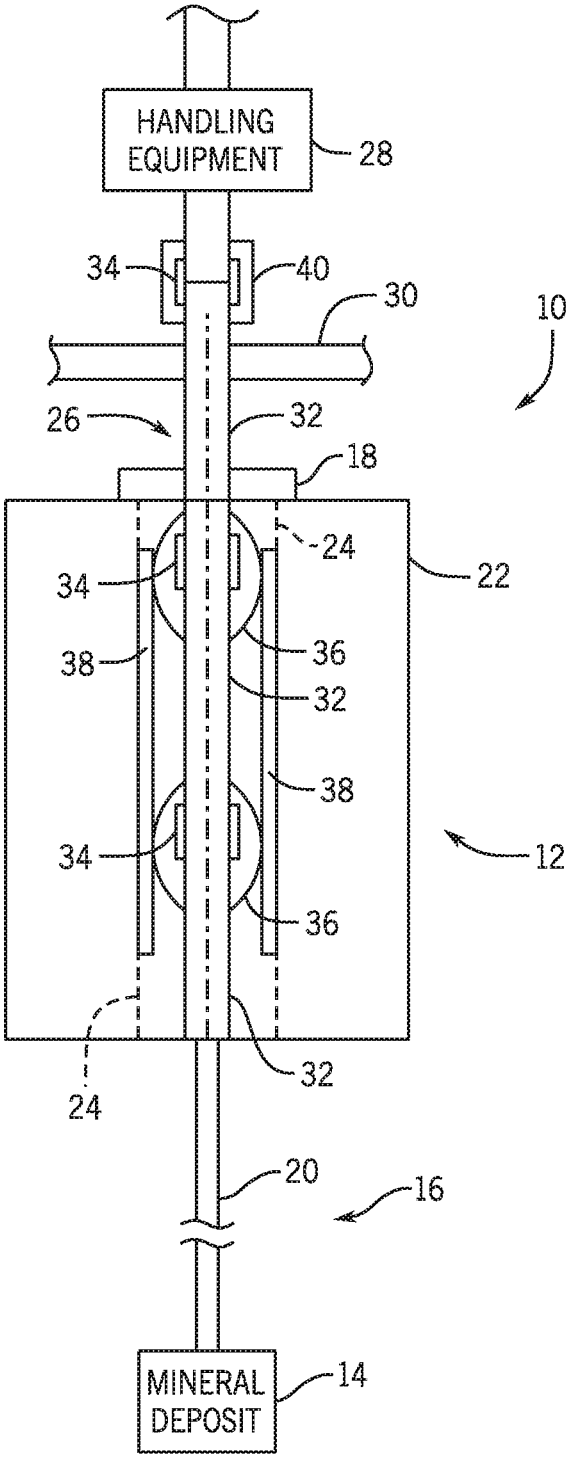
FIG. 1 is a schematic of a mineral extraction system including a wear bushing retrieval tool, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed toward a wear bushing retrieval tool for use in retrieving a wear bushing installed in a wellhead assembly. More particularly, present embodiments include a wear bushing retrieval tool that may be installed over and about a tubular string (e.g., casing string) being run into a wellbore through the wellhead assembly. For example, the wear bushing retrieval tool may be disposed about a coupling that couples or joins two lengths of tubular of the tubular string. With the wear bushing retrieval tool coupled to the tubular string, the wear bushing retrieval tool may be run into the wellhead assembly (e.g., toward the end of a tubular string running process) with the tubular string for retrieval of the wear bushing.

As discussed in detail below, it may be desirable to install a wear bushing within a wellhead assembly prior to running a tubular string (e.g., a casing string or tubular string) through the wellhead assembly into a wellbore in order to protect components (e.g., a sealing bore or wellhead bore) of the wellhead assembly from undesired or unintended contact with the tubular string or components of the tubular string as the tubular string is run into the wellbore. For example, the wear bushing may take the place of a casing hanger or tubing hanger within the wellhead assembly and may protect the wellhead bore from contact with a drill string tool joint, a drill bit, a bottom hole assembly, and so forth. Normally, the wear bushing may be removed after removal of the drill string from the wellbore and prior to running of casing string. However, present embodiments include a wear bushing retrieval tool that may remove a wear bushing during or after the tubular string (e.g., casing string) is run into the wellbore.

A tubular string may include centralizers (e.g., spring bow centralizers) disposed along the tubular string that help keep the tubular string in the center of the wellbore to facilitate proper cementing of the tubular string within the wellbore. However, such components may create undesired or unintended contact with the wellhead assembly. As the tubular string running operation nears completion, the wear bushing retrieval tool may be coupled to a coupling of the tubular string and may be run into the wellhead assembly with the tubular string. In the manner described below, the tubular string may be used to enable engaging of the wear bushing retrieval tool with the wear bushing within the wellhead assembly. After the wear bushing retrieval tool is engaged with the wear bushing within the wellhead assembly, the wear bushing retrieval tool may be decoupled or disengaged from the coupling of the tubular string as the tubular string is run further into the wellhead assembly. Thereafter, the wear bushing retrieval tool may be used to retrieve the wear bushing from the wellhead assembly prior to installing a mandrel hanger for suspending the tubular string in the wellhead.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or sub-sea (e.g., a sub-sea system). As illustrated, the system 10 includes a wellhead 12 (e.g., a wellhead assembly) coupled to a mineral deposit 14 via a well 16. The wellhead 12 may include a surface wellhead hub 18, and the well 16 may include a wellbore 20. The surface wellhead hub 18 generally includes a large diameter hub disposed above the wellhead 12.

The wellhead 12 generally includes a series of devices and components that control and regulate activities and conditions associated with the well 16. For example, the wellhead 12 may provide for routing the flow of produced minerals from the mineral deposit 14 and the wellbore 20, provide for regulating pressure in the well 16, and provide for the injection of chemicals into the wellbore 20 (down hole). In the illustrated embodiment, the wellhead 12 includes a main body 22 having an internal bore 24 (e.g., a sealing bore). The main body 22 may be comprised of multiple components, such as casing spools, tubing spools, wellhead adaptors, blowout preventers (BOPs), risers, and so forth. In operation, the wellhead 12 enables completion and workover procedures, such as the insertion of tools into the well 16 and the injection of various chemicals into the well 16. Further, minerals extracted from the well 16 (e.g., oil and/or natural gas) may be regulated and routed via the wellhead 12. For example, a BOP of the main body 22 may include a variety of valves, fittings, and controls to block oil, gas, or other fluid from exiting the well 16 in the event of an unintentional release of pressure or an overpressure condition.

After a drilling operation is competed to at least partially create the wellbore 20, a tubular string 26 may be run into the wellbore 20 through the wellhead 12. For example, handling equipment (e.g., tubular handling equipment) 28 at a rig floor 30 of the mineral extraction system 10 may be used to assemble lengths of tubular 32 (e.g., tubing or casing) to form the tubular string 26. As shown in the illustrated embodiment, lengths of tubular 32 may be coupled to one another via couplings 34 to form the tubular string 26. In certain embodiments, the tubular string 26 may include other components, such as centralizers 36 disposed about the tubular string 26 (e.g., disposed about the couplings 34). For example, the centralizers 36 may be rigid centralizers, spring bow type centralizers, or other type of centralizer. The centralizers 36 serve to keep the tubular string 26 from contacting the wellbore 20 wall to create an annular space around the tubular string 26 within the wellbore 20, which enables cement to seal the tubular string 26 within the wellbore 20 wall. As the tubular string 26 is assembled, the handling equipment 28 may be used to run tubular string 26 into the wellhead 12 and the wellbore 20. After the tubular string 26 running process, the tubular string 26 may be cemented into the wellbore 20. As will be appreciated, the tubular string 26 may serve to isolate and/or protect formations adjacent to the wellbore 20 and/or block collapse of the wellbore 20.

As the tubular string 26 is run through the wellhead 12, components of the wellhead 12 may be exposed to contact with the tubular string 26 and components coupled to the tubular string 26 (e.g., the centralizers 36). For example, spring bow centralizers are designed to interfere or contact with the wellbore 20 wall. In particular, the spring bow centralizers may compress against the wellbore 20 wall to mechanically centralize the tubular string 26 within the wellbore 20. However, the design of the spring bow centralizers 36 may cause interference between the bore 24 of the main body 22 and the centralizers 36 as the tubular string 26 is run into the wellbore 20. To block undesired or unintentional contact between the components of the wellhead 12 (e.g., the bore 24) and the tubular string 26 and its components (e.g., centralizers 36) as the tubular string 26 is run through the wellhead 12, one or more sleeves, bushings, or other components may be positioned within the wellhead 12. For example, in the illustrated embodiment, the wellhead 12 includes a wear bushing 38 disposed within the main body 22. The wear bushing 38 may protect the internal bore 24 from contact with the tubular string 26 and the centralizers 36 as the tubular string 26 is run into the wellbore 20 through the wellhead 12. Indeed, in certain embodiments, the centralizers 36 may have an outer diameter greater than an inner diameter of the wear bushing 38 and/or the internal bore 24 of the main body 22. Thus, the wear bushing 38 may be configured to withstand contact with the centralizers 36 and block contact between the internal bore 24 and the centralizers 36.

When the tubular string 26 running process is completed or near completion, it may be desirable to retrieve the wear bushing 38 from the wellhead 12. Accordingly, present embodiments include a wear bushing retrieval tool 40 for retrieving the wear bushing 38 from the wellhead 12. More specifically, the wear bushing retrieval tool 40 is configured to couple to one of the couplings 34 of the tubular string 26 (e.g., be disposed about and/or over the tubular string 26 and the coupling 34) as the final portion of the tubular string 26 is run through the wellhead 12. Thus, the tubular string 26 is used to run the wear bushing retrieval tool 40 into the wellhead 12. For example, the wear bushing retrieval tool 40 may be disposed about and coupled to one of the final couplings 34 of the tubular string 26 at the rig floor 30 before a final portion of the tubular string 26 is run into the wellbore 20 through the wellhead 12. In the manner described in detail below, the wear bushing retrieval tool 40 may be landed against and coupled to the wear bushing 38 within the wellhead 12 and subsequently decoupled from the tubular string 26 being run into the wellhead 12. Thereafter, the wear bushing retrieval tool 40 may be retrieved from the wellhead 12 along with the wear bushing 38 coupled to the wear bushing retrieval tool 40.

Figure 2:
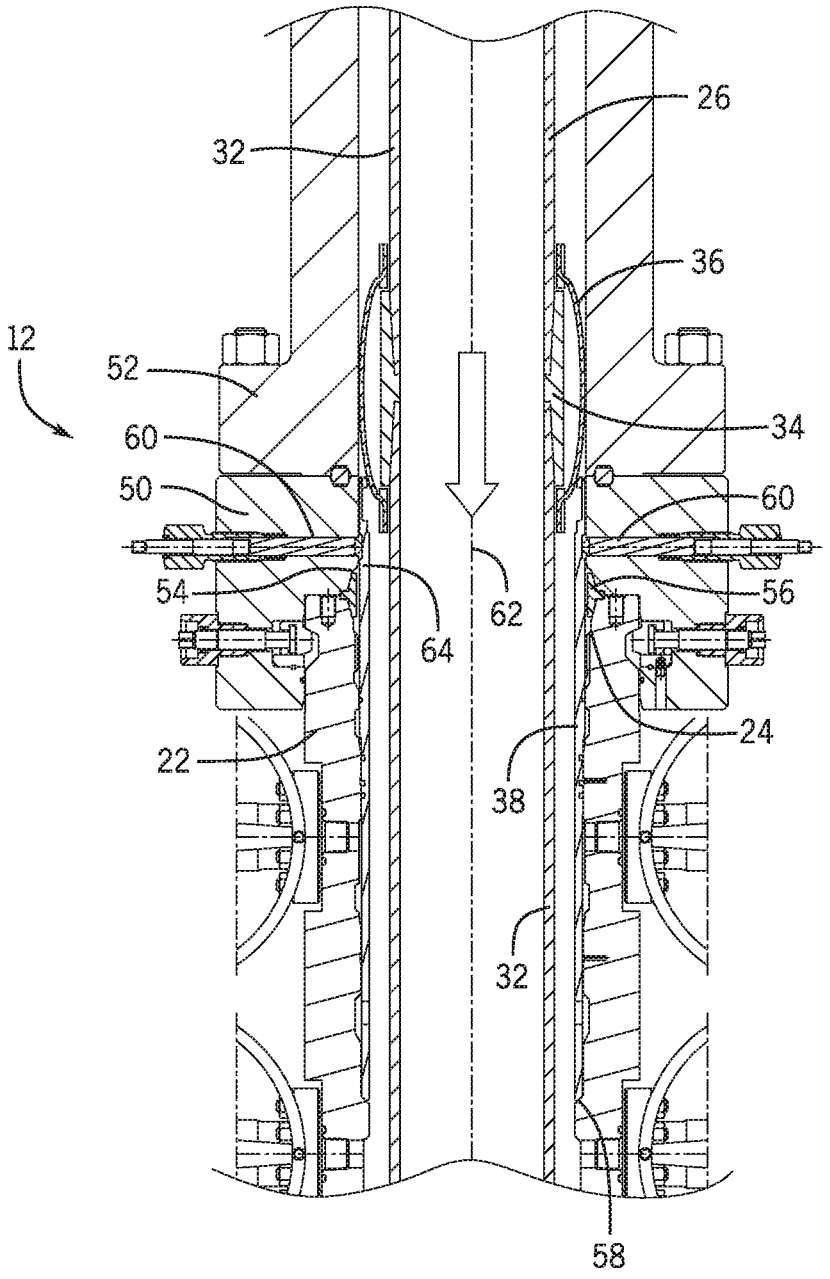
FIG. 2 is a cross-sectional side view of a wellhead assembly with a wear bushing disposed therein, illustrating a tubular string with a centralizer being run into the wellhead assembly, in accordance with an embodiment of the present disclosure.

FIG. 2 is a cross-sectional side view of the wellhead 12, illustrating the main body 22 and the tubular string 26 being run into the main body 22. The tubular string 26 includes one of the centralizers 36 (e.g., bow spring centralizers) disposed about one of the couplings 34 that couples two lengths of tubular 32 of the tubular string 26. As mentioned above, the wear bushing 38 is secured within the main body 22 to protect the internal bore 24 of the main body 22 from contact with the tubular string 26 and the centralizer 36. In the illustrated embodiment, a riser adapter 50 is coupled to the main body 22, and a riser 52 is coupled to the riser adapter 50. The wear bushing 38 in the illustrated embodiment also extends into the riser adapter 50 to protect an internal bore 54 of the riser adapter 50, as well as the internal bore 24 of the main body 22. The wear bushing 38 also protects one or more seals or sealing areas within the wellhead 12, such as a seal 56 disposed between the main body 22 and the riser adapter 50, from contact with the tubular string 26 and the centralizer 36.

In the illustrated embodiment, the wear bushing 38 is landed against a shoulder 58 of the main body 22. The wear bushing 38 is also held in place within the main body 22 and the riser adapter 50 via lock screws 60, which extend radially through the riser adapter 50 (relative to a central axis 62 of the wellhead 12) and engage with an annular recess 64 of the wear bushing 38. As described in detail below with reference to FIGS. 3-8, the wear bushing 38 may be retrieved from the wellhead 12 with the wear bushing retrieval tool 40 once or as the tubular string 26 running process is complete.

Figure 3:
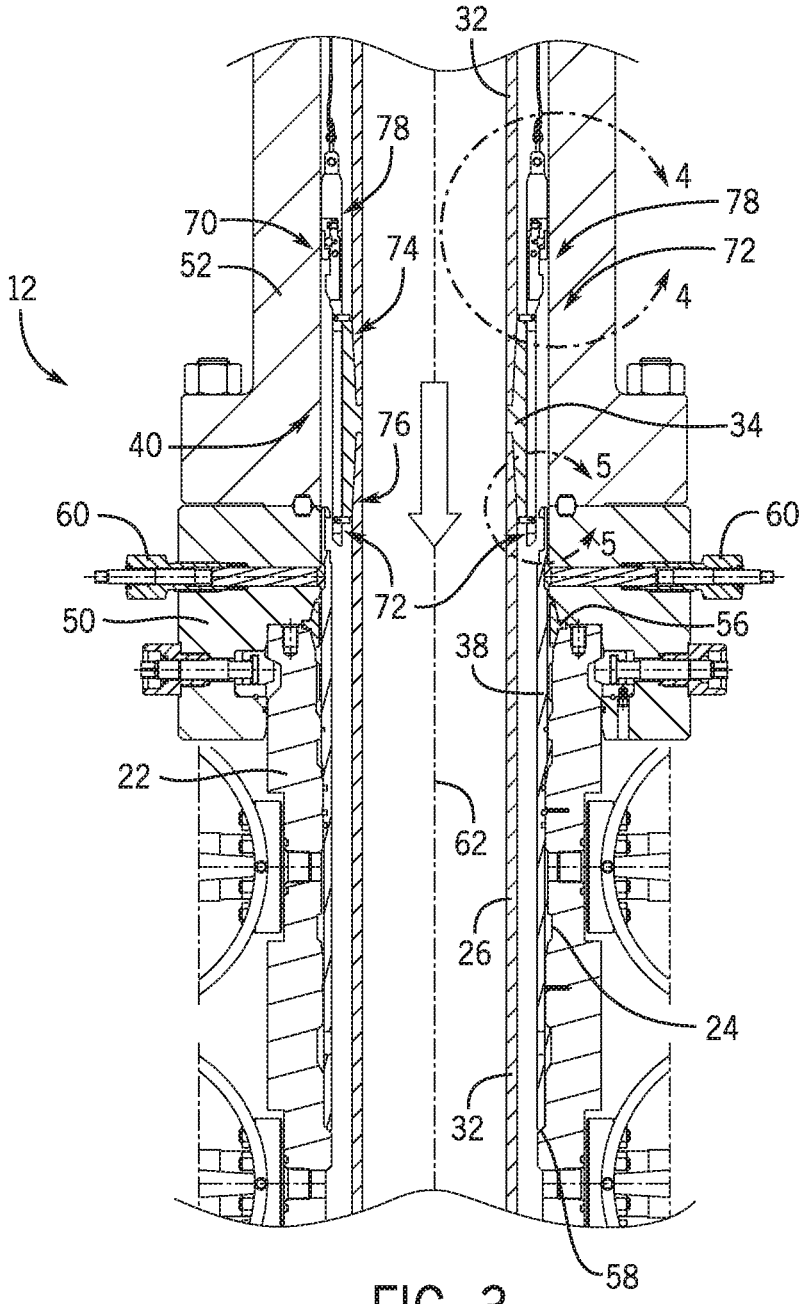
FIG. 3 is a cross-sectional side view of a wellhead assembly, illustrating a wear bushing retrieval tool coupled to the tubular string being run into the wellhead assembly, in accordance with an embodiment of the present disclosure.

FIG. 3 is a cross-sectional side view of the wellhead 12, illustrating the tubular string 26 being run into the wellhead 12 with the wear bushing retrieval tool 40 coupled to the tubular string 26 and disposed about one of the couplings 34 of the tubular string 26. As mentioned above, when the tubular string 26 running process nears completion, the wear bushing retrieval tool 40 may be coupled to the tubular string 26, and the tubular string 26 may be used to run the wear bushing retrieval tool 40 into the wellhead 12 for retrieval of the wear bushing 38.

The wear bushing retrieval tool 40 may be coupled to one of the couplings 34 of the tubular string 26 at the rig floor 30 of the mineral extraction system 10 when there are no more spring bow centralizers 36 to be run with the tubular string 26 into the wellhead 12. As described in greater detail below, the wear bushing retrieval tool 40 axially captures the coupling 34, such that the wear bushing retrieval tool 40 is secured in place on the tubular string 26 as the tubular string 26 is run through the wellhead 12. For example, the wear bushing retrieval tool 40 has a first securement feature 70 (e.g., first axial securement feature) and a second securement feature 72 (e.g., second axial securement feature). The first axial securement feature 70 is disposed at a first axial end 74 (e.g., upper end) of the coupling 34, and the second axial securement feature 72 is disposed at a second axial end 76 (e.g., a lower end) of the coupling 34. In certain embodiments, the wear bushing retrieval tool 40 may include a plurality of the first axial securement features 70 (e.g., disposed about a circumference of the first axial end 74 of the wear bushing retrieval tool 40) and/or a plurality of the second axial securement features 72 (e.g., disposed about a circumference of the second axial end 76 of the wear bushing retrieval tool 40).

With the wear bushing retrieval tool 40 secured in place on the tubular string 26, the wear bushing retrieval tool 40 is run into the wellhead 12, landed against the wear bushing 38, and coupled to the wear bushing 38 with one or more coupling features 78 of the wear bushing retrieval tool 40. In the manner described below, the first axial securement feature 70 and/or the second axial securement feature 72 are configured to enable release of the wear bushing retrieval tool 40 from the tubular string 26 once the wear bushing retrieval tool 40 is landed against the wear bushing 38. Details of the first axial securement feature 70, the second axial securement feature 72, and the one or more coupling features 78 of the wear bushing retrieval tool 40 are described below with reference to FIGS. 4-6.

Figure 5:
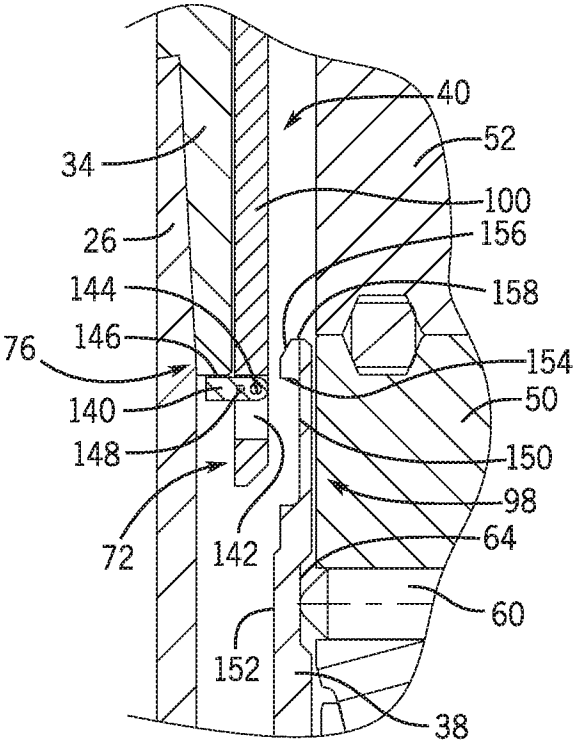
FIG. 5 is a partial cross-sectional side view, taken within line 5-5 of FIG. 3, of the wear bushing retrieval tool coupled to the tubular string and of the wear bushing disposed within a wellhead assembly, in accordance with an embodiment of the present disclosure.
Figure 4:
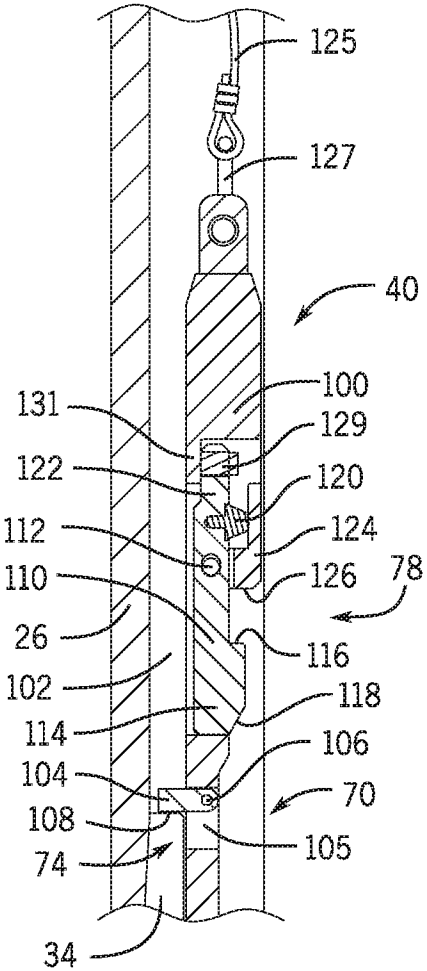
FIG. 4 is a partial cross-sectional side view, taken within line 4-4 of FIG. 3, of the wear bushing retrieval tool coupled to the tubular string, in accordance with an embodiment of the present disclosure.
Figure 6:
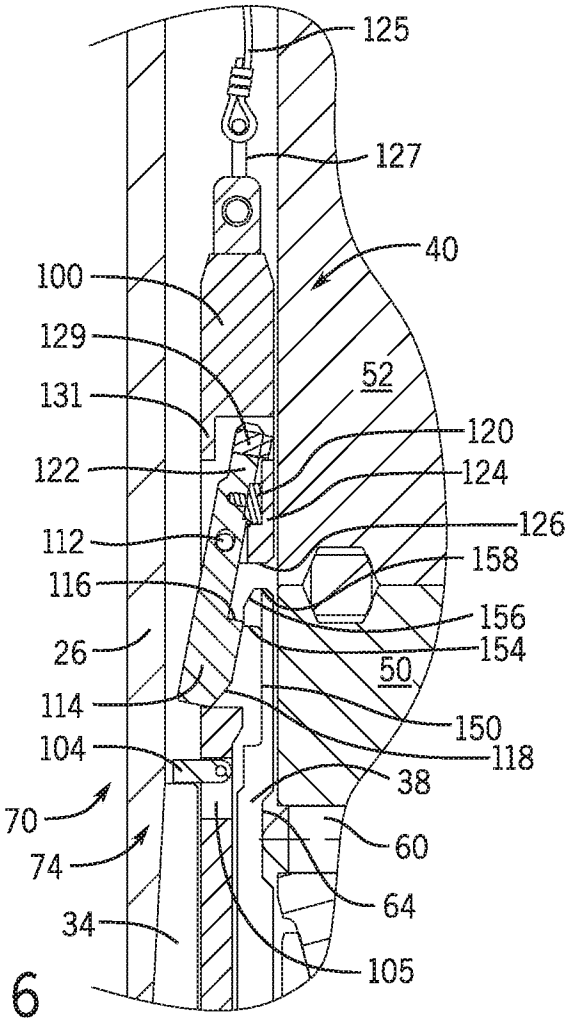
FIG. 6 is a partial cross-sectional side view of the wear bushing retrieval tool coupled to the tubular string and engaging with the wear bushing disposed in the wellhead assembly, in accordance with an embodiment of the present disclosure.

For example, FIG. 4 is a partial cross-sectional side view, taken within line 4-4 of FIG. 3, of the wear bushing retrieval tool 40 coupled to the tubular string 26, illustrating the first axial securement feature 70 and one of the coupling features 78 of the wear bushing retrieval tool 40. Additionally, FIG. 5 is a partial cross-sectional side view, taken within line 5-5 of FIG. 3, of the wear bushing retrieval tool 40 coupled to the tubular string 26, illustrating the second axial securement feature 72 and an upper portion 98 of the wear bushing 38 disposed within the wellhead 12. FIG. 6 is a partial cross-sectional side view of the wear bushing retrieval tool 40 coupled to the tubular string 26, illustrating engagement between the wear bushing retrieval tool 40 and the wear bushing 38.

As shown in FIG. 4, the wear bushing retrieval tool 40 includes a main body 100 (e.g., annular main body) that supports the coupling feature 78 and the first axial securement feature 70. The main body 100 defines a central cavity 102 through which the tubular string 26 extends when the main body 100 is disposed about the tubular string 26. The size or dimensions of the main body 100 (e.g., diameter, length, etc.) may be selected to accommodate any desired size of tubular string 26 and/or coupling 34.

When the main body 100 is disposed about the tubular string 26, the first axial securement feature 70 engages with the first axial end 74 of the coupling 34 of the tubular string 26. In the illustrated embodiment, the first axial securement feature 70 includes a key 104 that is at least partially disposed within a window or pocket 105 of the main body 100 and is rotatably coupled to the main body 100 via a hinge 106. Thus, the key 104 may be pivoted relative to the main body 100 of the wear bushing retrieval tool 40. When the wear bushing retrieval tool 40 is not coupled to the tubular string 26, the key 104 may be rotated via the hinge 106 (e.g., rotated counterclockwise) such that the key 104 is disposed entirely within the pocket 105.

To couple the wear bushing retrieval tool 40 to the coupling 34 and the tubular string 26, the key 104 is rotated away from the main body 100 such that key 104 extends radially inward (e.g., relative to the central axis 62 of the wellhead 12 and/or wear bushing retrieval tool 40). When the key 104 is extending radially inward, the key 104 may engage and land with a first axial end surface 108 (e.g., upper axial end surface) of the coupling 34. As a result, the key 104 of the first axial securement feature 70 blocks downward movement of the wear bushing retrieval tool 40 relative to the tubular string 26 and at least partially secures the wear bushing retrieval tool 40 to the coupling 34. As described in detail below, the second axial securement feature 72 includes a similar key that cooperatively captures (e.g., axially captures) the coupling 34 of the tubular string 26 with the key 104 of the first axial securement feature 70.

As shown, the main body 100 of the wear bushing retrieval tool 40 also supports the coupling feature 78 (e.g., a latching feature). The coupling feature 78 is configured to engage with the wear bushing 38 to enable retrieval of the wear bushing 38 from the wellhead 12 once no more spring bow centralizers 36 are to be run through the wellhead 12. While the illustrated embodiment shows one coupling feature 78, the wear bushing retrieval tool 40 may include any suitable number of coupling features 78, such as 2, 3, 4, 5, 6, 7, 8, or more coupling features 78. In certain embodiments, the coupling features 78 may be spaced equidistantly or generally equidistantly about the main body 100 (e.g., about a circumference of the main body 100) to help ensure that a majority of the coupling features 78 properly engage with the wear bushing 38 when the wear bushing retrieval tool 40 is landed against the wear bushing 38.

The coupling feature 78 includes a dog 110 (e.g., latch, hook, grapple, locking dog, etc.) that is pivotably coupled to the main body 100 via a hinge 112. The dog 110 is configured to engage with a groove or J-slot (e.g., groove 150 shown in FIGS. 5 and 6) of the wear bushing 38. To this end, the dog 110 has a hook portion 114 with an upper axial surface 116 that axially and radially overlaps with the wear bushing 38 (e.g., relative to the central axis 62 of the wellhead 12 and/or wear bushing retrieval tool 40) and abuts an upper surface of the groove of the wear bushing (e.g., upper surface 154 shown in FIGS. 5 and 6) when wear bushing retrieval tool 40 is landed against the wear bushing 38.

To enable engagement of the dog 110 and the wear bushing 38 (e.g., radial overlap of the upper axial surface 116 of the dog 110 and the upper surface of the groove of the wear bushing 38, the dog 110 includes a chamfered surface 118 faces axially downward and radially outward (e.g., relative to the central axis 62 of the wellhead 12 and/or wear bushing retrieval tool 40) when the wear bushing 38 is coupled to the tubular string 26. As the tubular string 26 and the wear bushing retrieval tool 40 are run into the wellhead 12, the chamfered surface 118 will eventually contact a chamfered surface of the wear bushing 38 (e.g., chamfered surface 156 shown in FIGS. 5 and 6). Engagement of the chamfered surfaces 118 and 156 forces the hook portion 114 of the dog 110 to pivot radially inward (e.g., relative to the central axis 62 of the wellhead 12 and/or wear bushing retrieval tool 40). Specifically, the dog 110 will pivot about the hinge 112 that couples the dog 110 to the main body 100.

The radially inward pivoting of the hook portion 114 of the dog 110 is resisted by a spring 120 coupled to an upper portion 122 of the dog 110 that is opposite the hook portion 114 relative to the hinge 112. The spring 120 may be any suitable material that stores mechanical energy. For example, the spring 120 may be an elastomeric material that is resistance to interference, wear, and/or degradation caused by mud, dirt, or other elements. When the engagement of the hook portion 114 of the dog 110 and the wear bushing 38 forces the hook portion 114 of the dog 110 radially inward, the upper portion 122 of the dog 110 may pivot radially outward (e.g., relative to the central axis 62 of the wellhead 12 and/or wear bushing retrieval tool 40) about the hinge 112. Thus, the spring 120 may be compressed between the upper portion 122 of the dog 110 and an outer flange 124 of the main body 100 of the wear bushing retrieval tool 40.

As the tubular string 26 and wear bushing retrieval tool 40 continue to be run into the wellhead 12, the hook portion 114 of the dog 110 will eventually pass (e.g., travel axially past) the chamfered surface 156 of the wear bushing 38, and the hook portion 114 will axially overlap and radially align with the groove 150 of the wear bushing 38. When the hook portion 114 of the dog 110 and the groove 150 of the wear bushing 38 radially align, the spring 120 that is compressed between the upper portion 122 of the dog 110 and the outer flange 124 of the main body 100 will expand and force the dog 110 to rotate counterclockwise about the hinge 112 and return to the aligned position shown in FIG. 4. With the hook portion 114 of the dog 110 and the groove 150 of the wear bushing 38 radially aligned and axially overlapped, the upper axial surface 116 of the dog 110 may abut and engage with the upper surface 154 of the groove 150 of the wear bushing 38. This abutment and engagement enables retrieval of the wear bushing 38 from the wellhead 12 with the wear bushing retrieval tool 40 via cables 125 coupled to the wear bushing retrieval tool 40 (e.g., via hooks 127). The cables 125 remain attached to the wear bushing retrieval tool 40 as the wear bushing retrieval tool 40 is run into the wellhead 12 with the tubular string 26. The cables 125 are used to retrieve the wear bushing retrieval tool 40 and the wear bushing 38 once the wear bushing retrieval tool 40 is decoupled from the tubular string 26 and the tubular string 26 running process is complete. For example, the cables 125 may be reeled in with a winch disposed at the rig floor 30. Once the wear bushing retrieval tool 40 is retrieved from the wellhead 12 with the wear bushing 38, a set screw 129 of the coupling feature 78 may be rotated and engaged with an inner flange 131 of the main body 100 to again pivot the dog 110 and disengage the dog 110 from the wear bushing 38.

At approximately the same time and/or shortly after the hook portion 114 of the dog 110 and the groove 150 of the wear bushing 38 radially align, a lower axial surface 126 of the outer flange 124 of the main body 100 will abut or land against an upper axial surface (e.g., upper axial surface 158 shown in FIGS. 5 and 6) of the wear bushing 38. This abutment between the lower axial surface 126 and the wear bushing 38 blocks further downward movement of the wear bushing retrieval tool 40 within the wellhead 12 and also enables decoupling of the wear bushing retrieval tool 40 from the tubular string 26, as described below.

As will be appreciated, the wear bushing 38, the wear bushing retrieval tool 40, and their respective components and/or features may be sized such that landing of the wear bushing retrieval tool 40 against the wear bushing 38 (e.g., abutment of the lower axial surface 126 and the upper axial surface 158) occurs shortly after the hook portion 114 of the dog 110 radially aligns and engages with the groove 150 of the wear bushing 38. In this way, an operator can verify that the one or more coupling features 78 are engaged with the wear bushing 38 when the wear bushing retrieval tool 40 is landed against the wear bushing 38.

As mentioned above, FIG. 5 is a partial cross-sectional side view, taken within line 5-5 of FIG. 3, of the wear bushing retrieval tool 40 coupled to the tubular string 26, illustrating the second axial securement feature 72 and an upper portion 98 of the wear bushing 38 disposed within the wellhead 12. When the main body 100 is disposed about the tubular string 26, the second axial securement feature 72 engages with the second axial end 76 of the coupling 34 of the tubular string 26. In the illustrated embodiment, the second axial securement feature 72 includes a key 140 that is at least partially disposed within a window or pocket 142 of the main body 100 and is rotatably coupled to the main body 100 via a hinge 144. Thus, the key 140 may be pivoted relative to the main body 100 of the wear bushing retrieval tool 40. When the wear bushing retrieval tool 40 is not coupled to the tubular string 26, the key 140 may be rotated via the hinge 144 (e.g., rotated counterclockwise) such that the key 140 is disposed entirely within the pocket 142.

To couple the wear bushing retrieval tool 40 to the coupling 34 and the tubular string 26, the key 140 is rotated away from the main body 100 such that key 140 extends radially inward (e.g., relative to the central axis 62 of the wellhead 12 and/or wear bushing retrieval tool 40). When the key 140 is extending radially inward, the key 140 may engage with a second axial end surface 146 (e.g., lower axial end surface) of the coupling 34. Additionally, the key 140 includes a shearing feature 148 (e.g., shear pin) that may engage with the key 140 and the main body 100 of the wear bushing retrieval tool 40 to block rotation (e.g., counterclockwise rotation) of the key 140. The shearing feature 148 may be installed in the key 140 after the wear bushing retrieval tool 40 is disposed over the tubular string 26. In other embodiments, the key 140 may be configured to snap into the radially inward configuration via an interference fit, a friction fit, or may be held in the radially inward configuration by another suitable method or mechanism. When the key 140 is extending radially inward, the key 140 of the second axial securement feature 72 blocks downward movement of the tubular string 26 and coupling 34 relative to the wear bushing retrieval tool 40. In this manner, the second axial securement feature 72 and the first axial securement feature 70 described above cooperatively capture (e.g., axially capture) the coupling 34 of the tubular string 26 and ensure that the wear bushing retrieval tool 40 is secured in place about the coupling 34 as the tubular string 26 and the wear bushing retrieval tool 40 are run into the wellhead 12.

As mentioned above, the upper portion 98 of the wear bushing 38 includes a groove 150 (e.g., annular groove) formed in an inner diameter 152 of the wear bushing 38. The groove 150 axially and radially overlaps with the dogs 110 of the coupling features 78 when the wear bushing retrieval tool 40 is landed against the wear bushing 38. The groove 150 includes an upper surface 154 that engages with the upper axial surface 116 of the hook portion 114 of the dog 110 when the dog 110 radially and axially overlaps with the groove 150. As mentioned above, the upper portion 98 of the wear bushing 38 also includes a chamfered surface 156 that contacts the chamfered surface 118 of the dog 110 when the tubular string 26 and wear bushing retrieval tool 40 are run into the wellhead 12. This engagement between the dog 110 and the wear bushing 38 will force the hook portion 114 of the dog 110 to pivot radially inward (e.g., relative to the central axis 62 of the wellhead 12 and/or wear bushing retrieval tool 40) as the hook portion 114 axially passes the chamfered surface 156.

As mentioned above, FIG. 6 is a partial cross-sectional side view of the wear bushing retrieval tool 40 coupled to the tubular string 26, illustrating engagement between the wear bushing retrieval tool 40 and the wear bushing 38. More particularly, FIG. 6 shows the wear bushing retrieval tool 40 and the wear bushing 38 after the chamfered surface 118 of the dog 110 and the chamfered surface 156 of the wear bushing 38 have engaged to drive the hook portion 114 of the dog 110 radially inward. In the illustrated embodiment, the hook portion 114 of the dog 110 and the groove 150 of the wear bushing 38 are approaching the point of axial and radial overlap. In particular, once the upper axial surface 116 of the hook portion 114 of the dog 110 axially passes the upper surface 154 of the groove 150, the spring 120 compressed between the upper portion 122 of the dog 110 and the outer flange 124 of the main body 100 will force the dog 110 to rotate counterclockwise about the hinge 112. At this point, the hook portion 114 of the dog 110 and the groove 150 of the wear bushing 38 will radially and axially overlap, and the wear bushing retrieval tool 40 will be engaged with the wear bushing 38.

Furthermore, as discussed above, shortly after the hook portion 114 of the dog 110 and the groove 150 of the wear bushing 38 are radially and axially overlapping, the lower axial surface 126 of the outer flange 124 of the main body 100 will abut or land against an upper axial surface 158 of the wear bushing 38. This abutment of the wear bushing retrieval tool 40 against the wear bushing 38 will block any further axial downward movement of the wear bushing retrieval tool 40 within the wellhead 12 and will facilitate decoupling of the wear bushing retrieval tool 40 from the tubular string 26.

Figure 7:
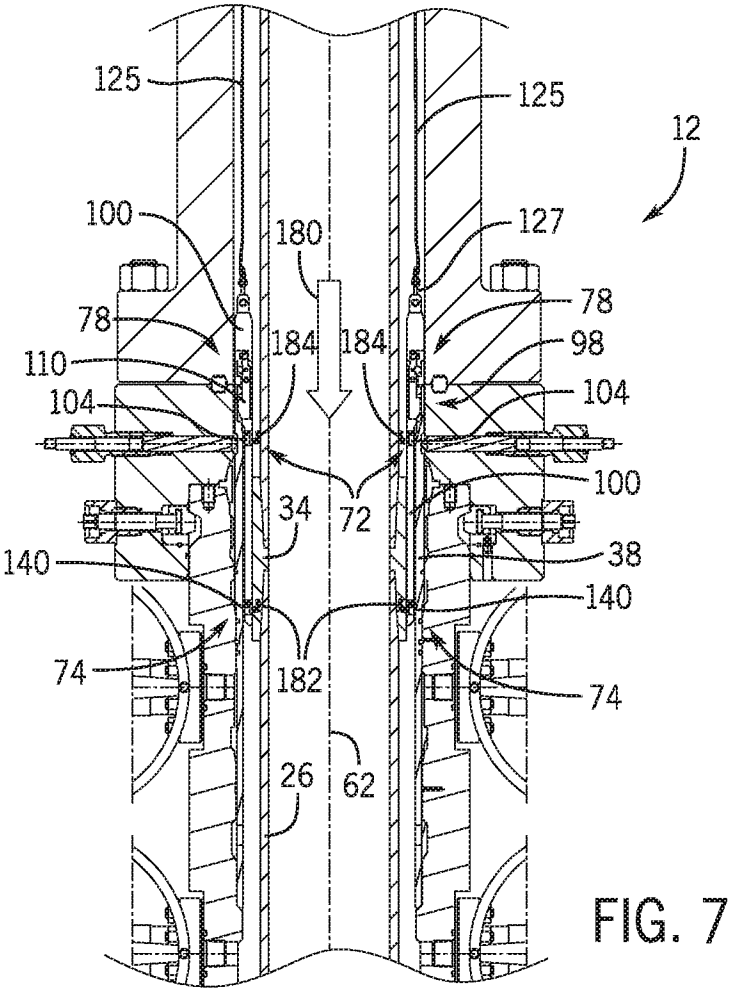
FIG. 7 is a cross-sectional side view of a wellhead assembly, illustrating the wear bushing retrieval tool engaged with the wear bushing in the wellhead assembly and disengaging from the tubular string being run into the wellhead assembly, in accordance with an embodiment of the present disclosure.

For example, FIG. 7 is a cross-sectional side view of the wellhead 12, illustrating the wear bushing retrieval tool 40 engaged with the wear bushing 38 and disengaging from the tubular string 26. As shown, the wear bushing retrieval tool 40 is landed against the wear bushing 38, which blocks axial downward movement of the wear bushing retrieval tool 40 within the wellhead 12. However, the tubular string 26 continues to be run into or through the wellhead 12, as indicated by arrow 180. As the tubular string 26 is run further through the wellhead 12, the downward force of the tubular string 26, and therefore the coupling 34, acting on the keys 140 of the second axial securement features 72 overcomes the ability of the keys 140 to remain in radially inward position shown in FIG. 5. For example, the downward force of the tubular string 26 and coupling 34 may shear the shearing feature 148 of the keys 140, and the keys 140 may be forced to rotate into their respective pockets 142 by the coupling 34, as shown by arrows 182 in FIG. 7. Similarly, as the tubular string 26 and the coupling 34 continue down into the wellhead 12, the keys 104 of the first axial securement features 70 may no longer abut the first axial end 74 of the coupling 34. Thus, the keys 104 of the first axial securement features 70 may also rotate or pivot into their respective pockets 105, as indicated by arrows 184. In this manner, the wear bushing retrieval tool 40 is decoupled from the coupling 34 and the tubular string 26 after the wear bushing retrieval tool 40 is landed and coupled to the wear bushing 38 within the wellhead 12.

While the illustrated embodiments show the first and second axial securement features 70 and 72 as keys 104 and 140, respectively, other embodiments of the wear bushing retrieval tool 40 may include other securement features (e.g., axial securement features). For example, the first and second axial securement features 70 and 72 may include tension screws or other components that may axially capture the coupling 34. In such embodiments, the first and second axial securement features 70 and 72 may still be configured to enable disengagement of the wear bushing retrieval tool 40 from the tubular string 26 after the wear bushing retrieval tool 40 is landed against the wear bushing 38 and the tubular string 26 continues to be run into the wellhead 12. However, in other embodiments, the first and second axial securement features 70 and 72 may not be configured to enable disengagement of the wear bushing retrieval tool 40 from the tubular string 26 as the tubular string 26 is continuously run into the wellhead 12. Instead, the wear bushing retrieval tool 40 may be secured or fixed to the coupling 34, the tubular string 26 may be run into the wellhead 12 to land the wear bushing retrieval tool 40 against the wear bushing 38 and engage the wear bushing retrieval tool 40 with the wear bushing 38, and then the tubular string 26 (and wear bushing retrieval tool 40 still coupled to the tubular string 26) may be pulled up to the rig floor 30 to retrieve the wear bushing retrieval tool 40 and wear bushing 38 from the wellhead 12.

Figure 8:
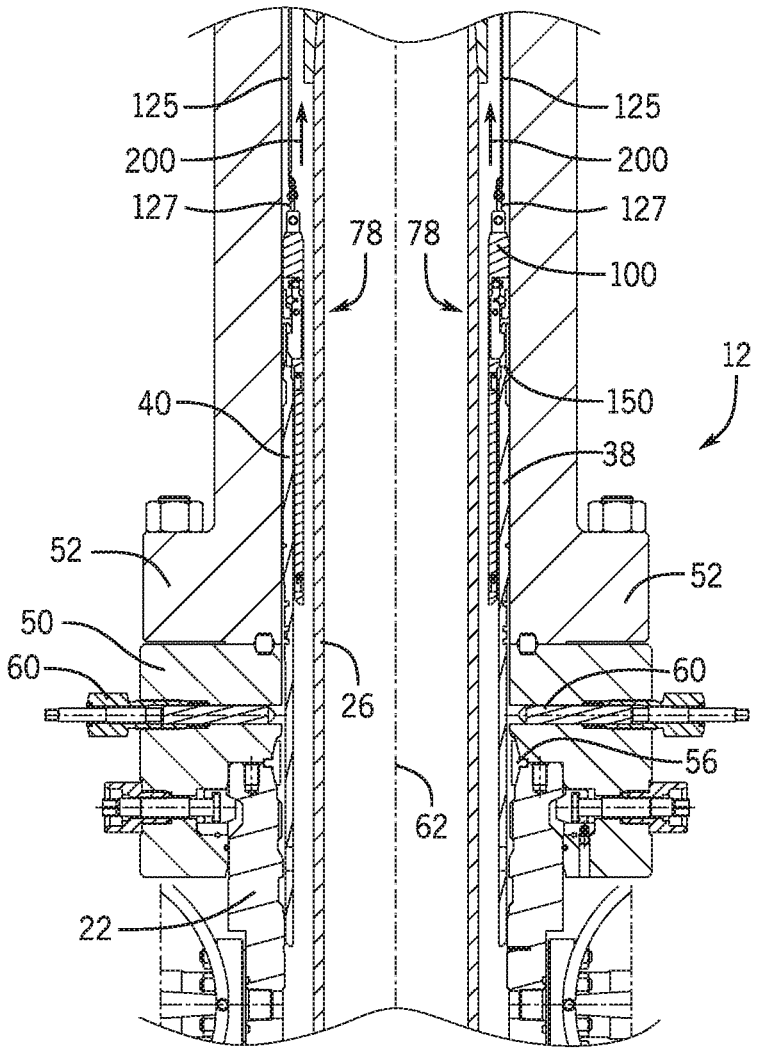
FIG. 8 is a cross-sectional side view of a wellhead assembly, illustrating retrieval of the wear bushing from the wellhead assembly with the wear bushing retrieval tool, in accordance with an embodiment of the present disclosure.

As the tubular string 26 running process is ongoing (e.g., before a mandrel hanger is attached to a final tubular string 36 joint), the wear bushing retrieval tool 40 and the wear bushing 38 may be retrieved from the wellhead 12. For example, FIG. 8 is a cross-sectional side view of an embodiment of the wellhead 12, illustrating retrieval of the wear bushing retrieval tool 40 and wear bushing 38 from the wellhead 12. As mentioned above, the wear bushing 38 is originally retained within the wellhead 12 by lock screws 60. When retrieval of the wear bushing retrieval tool 40 and the wear bushing 38 is desired, the lock screws 60 may be untightened to disengage from the wear bushing 38. With the lock screws 60 disengaged, derrick equipment (e.g., a winch) may be used to draw in the cables 125. As the cables 125 are reeled in, the wear bushing retrieval tool 40 and wear bushing 38 may be retrieved from the wellhead 12 (e.g., over the tubular string 26), as indicated by arrows 200. When the wear bushing 38 and the wear bushing retrieval tool 40 are fully retrieved from the wellhead 12 above the rig floor 30, the wear bushing 38 may be decoupled from the wear bushing retrieval tool 40 via the set screw 129 of the coupling feature 78, as described above. In certain embodiments, one or more of the keys (e.g., keys 104 and/or 140) of the coupling features 78 may be replaced prior to reuse of the wear bushing retrieval tool 40.

As described above, embodiments of the present disclosure are directed toward the wear bushing retrieval tool 40 for use in retrieving the wear bushing 38 installed in the wellhead 12. More particularly, the wear bushing retrieval tool 40 that may be installed over and about the tubular string 26 being run into the wellbore 20 through the wellhead 12. For example, the wear bushing retrieval tool 40 may be disposed about the coupling 34 that couples two lengths of tubular 32 of the tubular string 26. With the wear bushing retrieval tool 40 coupled to the tubular string 26, the wear bushing retrieval tool 40 may be run into the wellhead 12 with the tubular string 26 for retrieval of the wear bushing 38.

As discussed above, it may be desirable to install the wear bushing 38 within the wellhead 12 while running the tubular string 26 (e.g., casing string or tubing string) through the wellhead 12 in order to protect components (e.g., the sealing bore 24) of the wellhead 12 from undesired or unintended contact with the tubular string 26 or components of the tubular string 26 (e.g., the bow spring centralizers 36). As the tubular string 26 running operation nears completion, the wear bushing retrieval tool 40 is coupled to the tubular string 26 and is run into the wellhead 12 with the tubular string 26. In particular, the wear bushing retrieval tool 40 includes first and second securement features 70 and 72 that axially capture the coupling 34 to ensure that the wear bushing retrieval tool 40 remains in place on the tubular string 26 as the tubular string 26 is run into the wellhead 12.

The tubular string 26 is also used to enable coupling of the wear bushing retrieval tool 40 to the wear bushing 38 within the wellhead 12. That is, the tubular string 26 is used to land the wear bushing retrieval tool 40 against the wear bushing 38 and engage the wear bushing retrieval tool 40 with the wear bushing 38, in the manner described above. After the wear bushing retrieval tool 40 is coupled to the wear bushing 38 within the wellhead 12, the wear bushing retrieval tool 40 may be decoupled or disengaged from the coupling 34 of the tubular string 26 as the tubular string 26 is run further into the wellhead 12 and wellbore 20. In particular, the second axial securement features 72 may be configured to shear or release when force is applied to the tubular string 26 after the wear bushing retrieval tool 40 is landed against the wear bushing 38. Thereafter, the wear bushing retrieval tool 40 may be used to retrieve the wear bushing 38 from the wellhead 12.

In one embodiment, a system comprises a wear bushing retrieval tool comprising an annular main body configured to be disposed about and coupled to a tubular string, a plurality of coupling features, wherein each coupling feature of the plurality of coupling features is coupled to the annular main body via a respective hinge, a first key pivotably coupled to the annular main body, wherein the first key is configured to extend radially inward relative to a central axis of the annular main body, and a second key pivotably coupled to the annular main body, wherein the second key is configured to extend radially inward relative to the central axis of the annular main body. The system also comprises a wear bushing configured to be secured within a wellhead assembly, wherein the wear bushing comprises an annular groove formed in an inner diameter of the wear bushing, and wherein each coupling feature of the plurality of coupling features is configured to radially and axially overlap with the groove when the wear bushing retrieval tool is disposed within and landed against the wear bushing.

The system may further comprise the tubular string, wherein the tubular string comprises a first length of tubular, a second length of tubular, and a coupling joining the first length of tubular and the second length of tubular, wherein the first key of the wear bushing retrieval tool is disposed at a first axial end of the coupling, and the second key of the wear bushing retrieval tool is disposed at a second axial end of the coupling when the wear bushing retrieval tool is coupled to the tubular string. The system may further comprise a shear pin extending at least partially through the second key and the annular main body to hold the second key in a radially inward extended position. In the system, each coupling feature of the plurality of coupling features may comprise a hook portion disposed on a first side of the hinge and an upper portion disposed on a second side of the hinge opposite the first side of the hinge, wherein the hook portion is configured to radially and axially overlap with the groove when the wear bushing retrieval tool is disposed within and landed against the wear bushing. In the system, each coupling feature of the plurality of couplings features may comprise an elastomeric spring disposed between the upper portion and an outer flange of the annular main body and a set screw rotatably coupled to the upper portion, wherein the set screw is configured to engage with an inner flange of the annular main body.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a wear bushing retrieval tool, comprising:

an annular main body configured to be disposed about a tubular string;

a plurality of locking dogs, wherein each locking dog of the plurality of locking dogs is pivotably coupled to the annular main body;

a first axial securement feature coupled to the annular main body; and a second axial securement feature coupled to the annular main body, wherein the first and second axial securement features are axially offset from one another by an axial offset distance relative to a central axis of the annular main body, wherein the first and second axial securement features are configured to cooperatively axially capture a coupling of the tubular string via the axial offset distance when the annular main body is disposed about the tubular string and the wear bushing retrieval tool at least partially axially overlaps with the coupling.

2. The system of claim 1, wherein each locking dog of the plurality of locking dogs comprises a hook portion extending radially outward relative to the central axis of the annular main body, wherein the hook portion comprises an upper axial surface configured to engage with a groove of a wear bushing disposed within a wellhead.

3. The system of claim 2, wherein each locking dog of the plurality of locking dogs comprises a spring disposed between an upper portion of the locking dog and an outer flange of the annular main body, wherein the upper portion is opposite the hook portion relative to a hinge coupling the locking dog to the annular main body.

4. The system of claim 3, wherein the spring comprises an elastomeric material.

5. The system of claim 3, wherein each locking dog of the plurality of locking dogs comprises a set screw extending through the upper portion of the locking dog, and wherein the set screw abuts an inner flange of the annular main body.

6. The system of claim 1, wherein the first axial securement feature comprises a first key pivotably coupled to the annular main body, wherein the first key is configured to extend radially inward from the annular main body and engage with a first axial end of the coupling of the tubular string.

7. The system of claim 6, wherein the second axial securement feature comprises a second key pivotably coupled to the annular main body, wherein the second key is configured to extend radially inward from the annular main body and engage with a second axial end of the coupling of the tubular string opposite the first axial end of the coupling.

8. The system of claim 7, wherein the second axial securement feature comprises a shear pin configured to hold the second key in a radially extended position.

9. The system of claim 1, wherein the plurality of locking dogs is configured to couple the wear bushing retrieval tool to a wear bushing, and the wear bushing retrieval tool is configured to retrieve the wear bushing separate from or without the tubular string.

10. The system of claim 1, wherein each locking dog of the plurality of locking dogs comprises a chamfered surface facing axially downward and radially outward relative to the central axis of the annular main body when the wear bushing retrieval tool is coupled to the coupling.

11. A method, comprising:

running a tubular string into a wellbore through a wellhead;

disposing a wear bushing retrieval tool about the tubular string;

axially capturing a coupling of the tubular string with a first axial securement feature and a second axial securement feature of the wear bushing retrieval tool;

running the wear bushing retrieval tool into the wellhead with the tubular string;

landing the wear bushing retrieval tool against a wear bushing disposed within the wellhead;

engaging a plurality of locking dogs of the wear bushing retrieval tool with a groove of the wear bushing;

decoupling the wear bushing retrieval tool from the tubular string by releasing at least one of the first or second securement features from the coupling of the tubular string; and retrieving the wear bushing retrieval tool and the wear bushing from the wellhead separate from or without the tubular string.

12. The method of claim 11, wherein decoupling the wear bushing retrieval tool from the tubular string comprises shearing at least one shear pin of the second axial securement feature by running the tubular string further into the wellhead after landing the wear bushing retrieval tool against the wear bushing disposed within the wellhead.

13. The method of claim 11, wherein retrieving the wear bushing retrieval tool and the wear bushing from the wellhead comprises reeling in cables coupled to the wear bushing retrieval tool.

14. The method of claim 11, comprising engaging a first chamfered surface of each locking dog of the plurality of locking dogs with a second chamfered surface of the wear bushing before engaging the plurality of locking dogs of the wear bushing retrieval tool with the groove of the wear bushing.

15. The method of claim 11, wherein engaging the plurality of locking dogs of the wear bushing retrieval tool with the groove of the wear bushing comprises abutting an upper axial surface of the groove with an upper axial surface of each locking dog of the plurality of locking dogs.

16. A system, comprising:

a wear bushing retrieval tool, comprising:

an annular main body configured to be disposed about and coupled to a tubular string;

a plurality of coupling features, wherein each coupling feature of the plurality of coupling features is coupled to the annular main body via a respective hinge;

a first key pivotably coupled to the annular main body, wherein the first key is configured to extend radially inward relative to a central axis of the annular main body and engage the tubular string; and a second key pivotably coupled to the annular main body, wherein the second key is configured to extend radially inward relative to the central axis of the annular main body and engage the tubular string; and a wear bushing configured to be secured within a wellhead assembly, wherein the wear bushing comprises an annular groove formed in an inner diameter of the wear bushing, and wherein each coupling feature of the plurality of coupling features is configured to radially and axially overlap with the annular groove when the wear bushing retrieval tool is disposed within and landed against the wear bushing.

17. The system of claim 16, comprising the tubular string, wherein the tubular string comprises:

a first length of tubular;

a second length of tubular; and a coupling joining the first length of tubular and the second length of tubular, wherein the first key of the wear bushing retrieval tool is disposed at a first axial end of the coupling, and the second key of the wear bushing retrieval tool is disposed at a second axial end of the coupling when the wear bushing retrieval tool is coupled to the tubular string.

18. The system of claim 16, comprising a shear pin extending at least partially through the second key and the annular main body to hold the second key in a radially inward extended position.

19. The system of claim 16, wherein each coupling feature of the plurality of coupling features comprises a hook portion disposed on a first side of the hinge and an upper portion disposed on a second side of the hinge opposite the first side of the hinge, wherein the hook portion is configured to radially and axially overlap with the annular groove when the wear bushing retrieval tool is disposed within and landed against the wear bushing.

20. The system of claim 16, wherein each coupling feature of the plurality of couplings features comprises:

a spring disposed between the coupling feature and the annular main body at a first offset distance from the hinge; and a set screw rotatably coupled to the coupling feature at a second offset distance from the hinge, wherein the set screw is configured to engage with a portion of the annular main body.

* * * * *